US010081776B2

(12) United States Patent
Marks et al.

(10) Patent No.: US 10,081,776 B2
(45) Date of Patent: Sep. 25, 2018

(54) CYCLEN FRICTION MODIFIERS FOR BOUNDARY LUBRICATION

(71) Applicant: Northwestern University, Evanston, IL (US)

(72) Inventors: Tobin J. Marks, Evanston, IL (US); Qian Wang, Prospect, IL (US); Yip-Wah Chung, Wilmette, IL (US); Massimiliano Delferro, Chicago, IL (US); Michael Desanker, Evanston, IL (US); Xingliang He, Evanston, IL (US)

(73) Assignee: Northwestern University, Evanston, IL (US)

( * ) Notice: Subject to any disclaimer, the term of this patent is extended or adjusted under 35 U.S.C. 154(b) by 0 days.

(21) Appl. No.: 15/152,284

(22) Filed: May 11, 2016

(65) Prior Publication Data

US 2016/0333288 A1 Nov. 17, 2016

Related U.S. Application Data

(60) Provisional application No. 62/179,564, filed on May 11, 2015.

(51) Int. Cl.
*C10M 133/38* (2006.01)
*C10M 169/04* (2006.01)

(52) U.S. Cl.
CPC .. *C10M 133/38* (2013.01); *C10M 2203/1025* (2013.01); *C10M 2215/22* (2013.01); *C10M 2215/222* (2013.01); *C10N 2230/06* (2013.01); *C10N 2230/08* (2013.01); *C10N 2230/56* (2013.01); *C10N 2240/10* (2013.01); *C10N 2240/104* (2013.01)

(58) Field of Classification Search
CPC combination set(s) only.
See application file for complete search history.

(56) References Cited

U.S. PATENT DOCUMENTS

| | | | |
|---|---|---|---|
| 3,251,853 | A | 5/1966 | Hoke |
| 3,275,554 | A | 9/1966 | Wagenaar |
| 3,438,757 | A | 4/1969 | Anderson et al. |
| 3,932,290 | A | 1/1976 | Koch et al. |
| 3,955,940 | A | 5/1976 | Hollyday |
| 4,505,835 | A | 3/1985 | Sung et al. |
| 4,612,132 | A | 9/1986 | Wollenberg et al. |

(Continued)

FOREIGN PATENT DOCUMENTS

| | | |
|---|---|---|
| EP | 1568759 A2 | 8/2005 |
| EP | 2746370 A1 | 6/2014 |

(Continued)

OTHER PUBLICATIONS

Jones, G. O. et al., "Computational and Experimental Studies on the Mechanism of Formation of Poly (hexahydrotriazine)s and Poly(hemiaminal)s from the Reactions of Amines with Formaldehyde", Org. Lett. 2014, 16, 5502-5505.

(Continued)

*Primary Examiner* — Ellen McAvoy
*Assistant Examiner* — Chantel Graham
(74) *Attorney, Agent, or Firm* — Reinhart Boerner Van Deuren S.C.

(57) ABSTRACT

Compositions comprising one or more cyclen compounds which can be structurally modified to affect anti-friction and anti-wear functionality.

35 Claims, 13 Drawing Sheets

(56) References Cited

U.S. PATENT DOCUMENTS

Figure 1A:
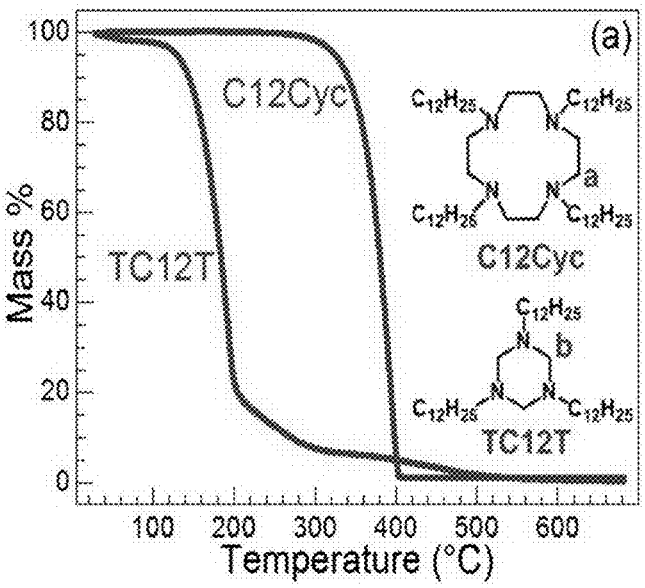

| | | | | |
|---|---|---|---|---|
| 4,661,271 | A | 4/1987 | Horodysky et al. | |
| 4,910,263 | A | 3/1990 | Brois et al. | |
| 5,484,543 | A | 1/1996 | Chandler et al. | |
| 6,835,217 | B1 | 12/2004 | DeRosa et al. | |
| 8,703,680 | B2 | 4/2014 | Suen | |
| 2004/0002434 | A1 | 1/2004 | Perkins et al. | |
| 2005/0033106 | A1 | 2/2005 | Wong et al. | |
| 2007/0160526 | A1 | 7/2007 | Bruce et al. | |
| 2009/0318319 | A1 | 12/2009 | Devlin et al. | |
| 2010/0041572 | A1 | 2/2010 | Sano et al. | |
| 2011/0021393 | A1 | 1/2011 | Kasai | |
| 2012/0231297 | A1 | 9/2012 | Sugiura et al. | |
| 2012/0238481 | A1 | 9/2012 | Kamano | |
| 2014/0011721 | A1 | 1/2014 | Sheets et al. | |
| 2014/0051616 | A1 | 2/2014 | Devlin et al. | |
| 2017/0050988 | A1 * | 2/2017 | Hu | C07D 403/14 |

FOREIGN PATENT DOCUMENTS

| | | | |
|---|---|---|---|
| EP | 2746371 | A1 | 6/2014 |
| WO | 2010096325 | A1 | 8/2010 |
| WO | 2012025901 | A1 | 3/2012 |
| WO | 2012151084 | A1 | 11/2012 |
| WO | 2014136911 | A1 | 9/2014 |
| WO | 2015027367 | A1 | 3/2015 |

OTHER PUBLICATIONS

Graymore, J., "The reduction products of certain cyclic methyleneamines", J. Chem. Soc., 1932, 1353-1357.

Xiong, X.-Q. et al., "Transcription-Inhibition and Antitumor Activities of N-Alkylated Tetraazacyclododecanes", Chem. Biodivers., 2007, 4, 2791-2797.

Lopes, P. E. M. et al., "Development of an Empirical Force Field for Silica. Application to the Quartz-Water Interface", J. Phys. Chem. B, 2006, 110, 2782-2792.

Rappe, A. K. et al., "Charge equilibration for molecular dynamics simulations", J. Phys. Chem., 1991, 95, 3358-3363.

Tersoff, J., "New empirical approach for the structure and energy of covalent systems", Phys. Rev. B 1988, 37, 6991.

Dauber-Osguthorpe, P., "Structure and energetics of ligand binding to proteins: *Escherichia coli* dihydrofolate reductase-trimethoprim, a drug-receptor system", Proteins: Struct., Funct., Bioinf. 2004, 4, 31.

Maple, J. R. et al., "Derivation of force fields for molecular mechanics and dynamics from ab initio energy surfaces", Proc. Natl. Acad. Sci. U.S.A. 1988, 85, 5350.

International Search Report and Written Opinion for PCT/US2016/031868 dated Oct. 26, 2016, 14 pages.

* cited by examiner

Figure 2A
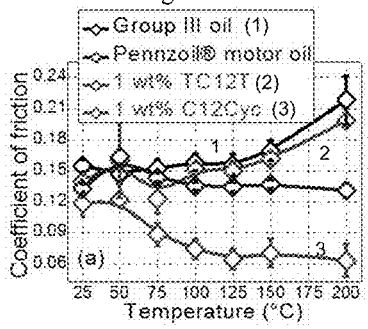
Figure 2C
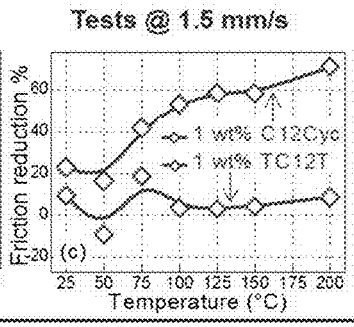
Figure 2E
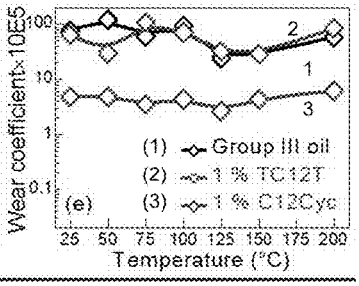
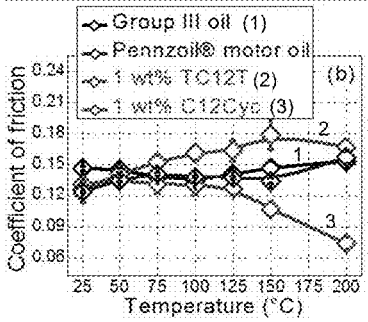
Figure 2B
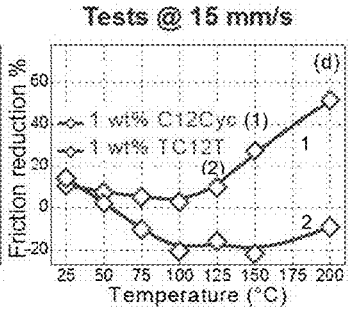
Figure 2D
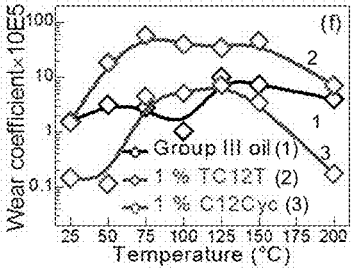
Figure 2F Figure 5A
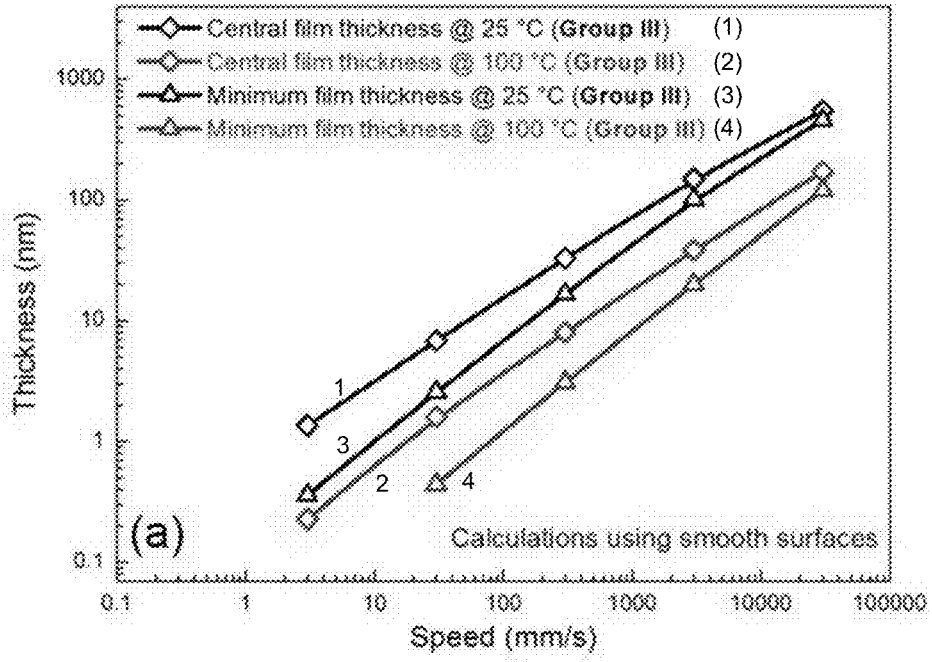
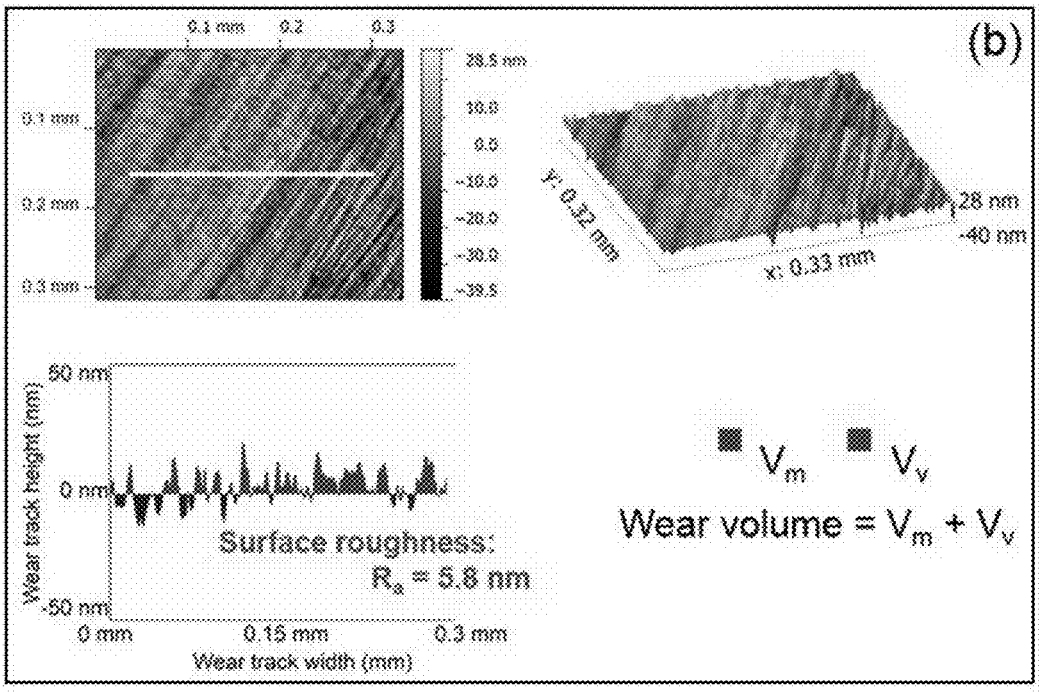
Figure 5B Figure 9A
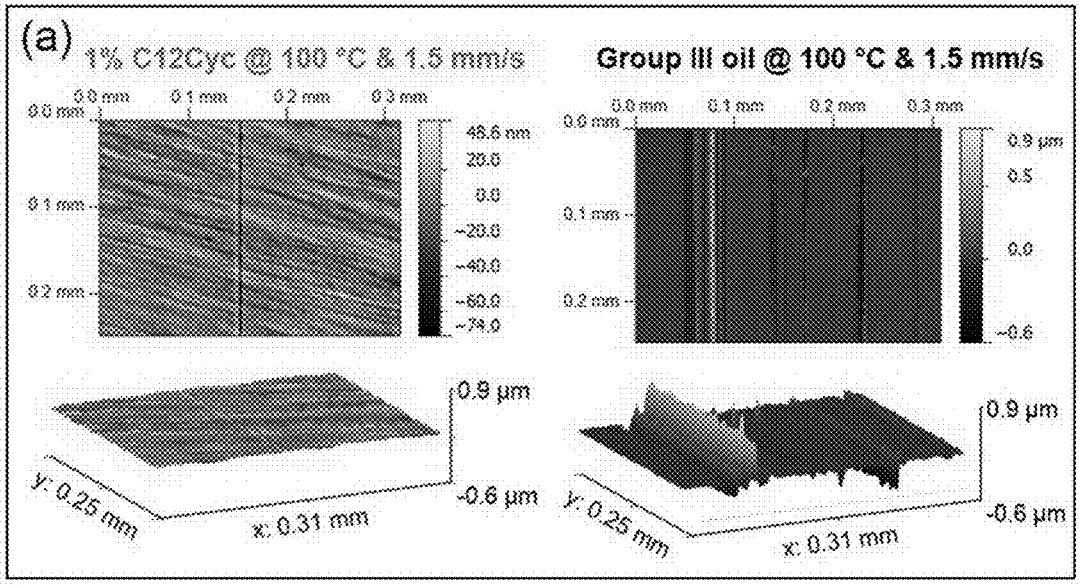
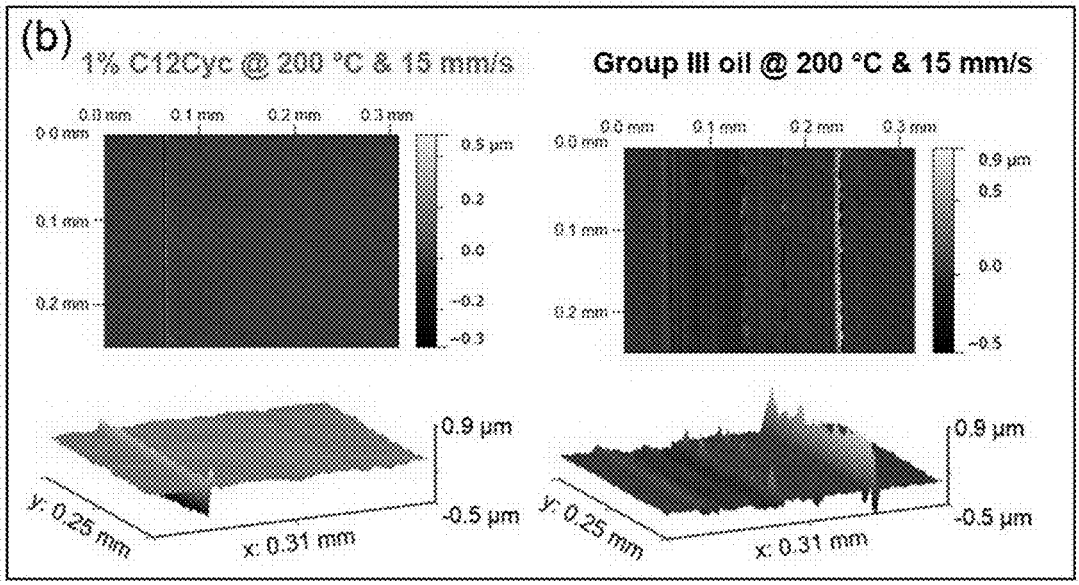
Figure 9B

CYCLEN FRICTION MODIFIERS FOR BOUNDARY LUBRICATION

This application claims priority to and the benefit of application Ser. No. 62/179,564 filed on May 11, 2015, the entirety of which is incorporated herein by reference.

This invention was made with government support under DE-EE0006449 awarded by the Department of Energy. The government has certain rights in the invention.

BACKGROUND OF THE INVENTION

Friction costs a significant amount of undesirable energy and fuel consumption, decreases component lifetime, and contributes to environmentally harmful emissions. In 2009, passenger cars worldwide consumed ~56 billion gallons of fuel (diesel and gasoline) to overcome friction in their engines, transmissions, tires, and brakes. Friction in the boundary lubrication (BL) regime is generally the most severe, and thus critically impacts fuel efficiency and lifetime of the powertrain components in motor vehicles.

Both organic and inorganic friction modifiers (FMs) have been widely used in engine oils to reduce BL regime friction. Organic FMs are generally long, slim molecules with a straight hydrocarbon chain and a polar group at one end. The effectiveness of these additives is, in a large part, determined by the ability to form an adsorbed molecular layer on a surface. This functionality can be achieved through a polar head which can undergo chemical interactions with the metal surface via physisorption or chemisorption. Enhancing the polarity of such an end group could strengthen surface adsorption of FM molecules and improve anti-friction functionality in the BL regime.

SUMMARY OF THE INVENTION

In light of the foregoing, it can be an object of the present invention to provide various friction modifier compositions, related composites and/or methods of using such compositions to reduce boundary lubrication friction, thereby overcoming various deficiencies and shortcomings of the prior art, including those outlined above. It will be understood by those skilled in the art that one or more aspects of this invention can meet certain objectives, while one or more other aspects can meet certain other objectives. Each objective may not apply equally, in all its respects, to every aspect of this invention. As such, the following objects can be viewed in the alternative with respect to any one aspect of this invention.

It can be an object of the present invention to provide a molecular scaffold affording structural variation and corresponding anti-friction and anti-wear functionality.

It can also be an object of the present invention to provide a range of cyclen friction modifier compounds to reduce boundary lubrication regime friction.

It can also be an object of the present invention, alone or in conjunction with one or more of the proceeding objectives, to provide one or more cyclen compounds for incorporation into a range of oil compositions, including without limitation motor oil compositions of the sort useful in the lubrication of crank train, valve train, piston liner and various other components of a gasoline engine.

Other objects, features, benefits and advantages of the present invention will be apparent from this summary and its descriptions of certain embodiments, and will be readily apparent to those skilled in the art having knowledge of oil compositions and their use to reduce boundary lubrication friction. Such objects, features, benefits and advantages will be apparent from the above as taken into conjunction with the accompanying examples, data, figures and all reasonable inferences to be drawn therefrom.

In part, the present invention can be directed to a composition comprising an oil component and a component comprising at least one cylen compound of a formula

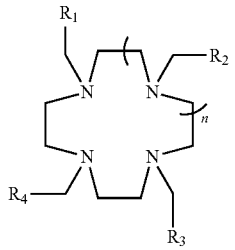

wherein each of $R_1$, $nR_2$, $R_3$ and $R_4$ ($R_1$-$R_4$) can be a moiety independently selected from about $C_5$-about $C_{24}$ linear, substituted linear, branched and substituted branched alkyl moieties, where such substituents can be selected from mono- and multi-valent substituents including but not limited to oxa (—O—), aza (—NH— or —N—), aryl, carbonyl, alkylcarbonyl, arylcarbonyl, oxycarbonyl (—OC(O)—), alkoxycarbonyl, amido (—NHC(O)—), alkylcarboxamido, arylcarboxamido, hydroxy, alkoxy, aryloxy, amino, alkylamino, arylamino, heteroaryl, heteroarylalkyl, heteroaryloxy and combinations of such substituents; and n can be an integer selected from 0-about 10 or greater. Each of $nR_2$ can be the same moiety, or different from at least one of another and independently selected from such moieties to provide a mixture thereof. Accordingly, each of $R_1$-$R_4$ can, without limitation, be independently selected from a wide range of alkyl, ether, alcohol, ester, amine, amide, ketone and aldehyde moieties.

In certain embodiments, each of $R_1$-$R_4$ can be independently selected from any of said $C_{10}$-$C_{20}$ moieties. In certain such embodiments, at least $R_1$ can be a linear $C_{11}$ alkyl moiety. Without limitation, each of $R_1$-$R_4$ can be a $C_{11}$-$C_{18}$ alkyl moiety. More specifically, without limitation, each of $R_1$-$R_4$ can be a $C_{11}$ linear, unsubstituted alkyl moiety. As a separate consideration, without limitation as to any $R_1$-$R_4$ moieties, a composition of this invention can comprise a plurality of such cyclen compounds. Regardless, such an oil component can be selected from base oils and formulated commercially-available motor oils. As used in conjunction therewith, one or more such cyclen compounds can be up to about 0.1 wt. %, to about 0.2 wt. % . . . to about 0.5 wt. % . . . or to about 1.0 wt. % or more of such a composition.

In part, the present invention can also be directed to a composition comprising an oil component and a component comprising at least one cyclen compound of a formula

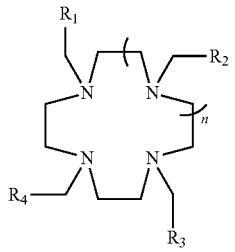

wherein each of $R_1$, $nR_2$, $R_3$ and $R_4$ ($R_1$-$R_4$) can be a moiety independently selected from about $C_5$-about $C_{24}$ linear and branched alkyl moieties; and n can be an integer selected from 0-about 10. Such alkyl moieties can be as discussed above or illustrated elsewhere herein. In certain embodiments, such an oil component can be selected from base oils and formulated commercially-available motor oils. In certain such embodiments, such a cyclen component can be about 0.1 wt. % to about 1.0 wt. % of such a composition. Regardless, such a cyclen component can comprise a plurality of cyclen compounds.

In part, the present invention can also be directed to a composite comprising a metal substrate and a composition of the sort described above or illustrated elsewhere herein, such a composition coupled to such a substrate. Without limitation, each of the N-heteroatoms of such a cyclen compound can be adsorbed to the surface of such a substrate, as can be observed or determined at temperatures up to and greater than about 200° C. Regardless, an oil component of such a composition can be a formulated, commercially-available motor oil. Without limitation as to the identity of any particular oil component, a cyclen component used in conjunction therewith can be as discussed above or illustrated elsewhere herein. As can be indicative thereof, such a resulting composite can provide a water contact angle greater than about 90 degrees.

In part, the present invention can also be directed to a method of using a cyclen compound to reduce boundary lubrication friction. Such a method can comprise providing opposed first and second metal substrates; applying an oil-cyclen composition of this invention to at least one such metal substrate; and contacting such opposed metal substrates, such contact inducing boundary lubrication friction therebetween, such a composition in an amount sufficient to reduce boundary lubrication friction between such substrates as compared to boundary lubrication friction induced by substrate contact with application of a composition absent such a cyclen compound. Without limitation, an oil component and one or more cyclen compounds of such a composition can be as discussed above or illustrated elsewhere herein. Regardless, such first and second metal substrates can be selected from the crank train, valve train and piston liner components of a gasoline engine. Such contact can be over a temperature range of about 20° C. to about 260° C., and friction reduction can be realized over such a temperature range.

DETAILED DESCRIPTION OF THE DRAWINGS

Figure 1B:
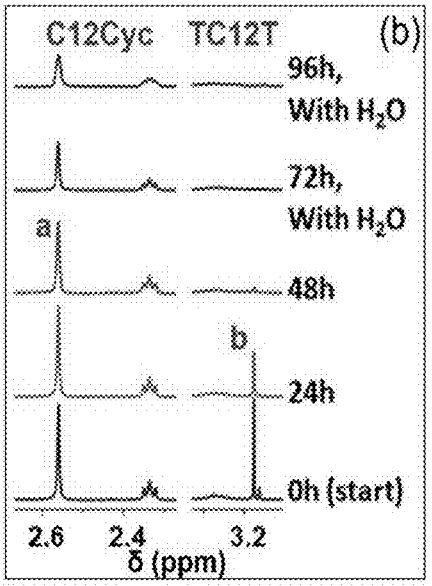

FIGS. 1A-B. (A) TGA curves of C12Cyc and TC12T. Molecular structures inset in plot. (B) 1H NMR spectra (only showing cyclic protons) for C12Cyc (left) and TC12T (right) during extended heating at 90° C.

Figure 1C:
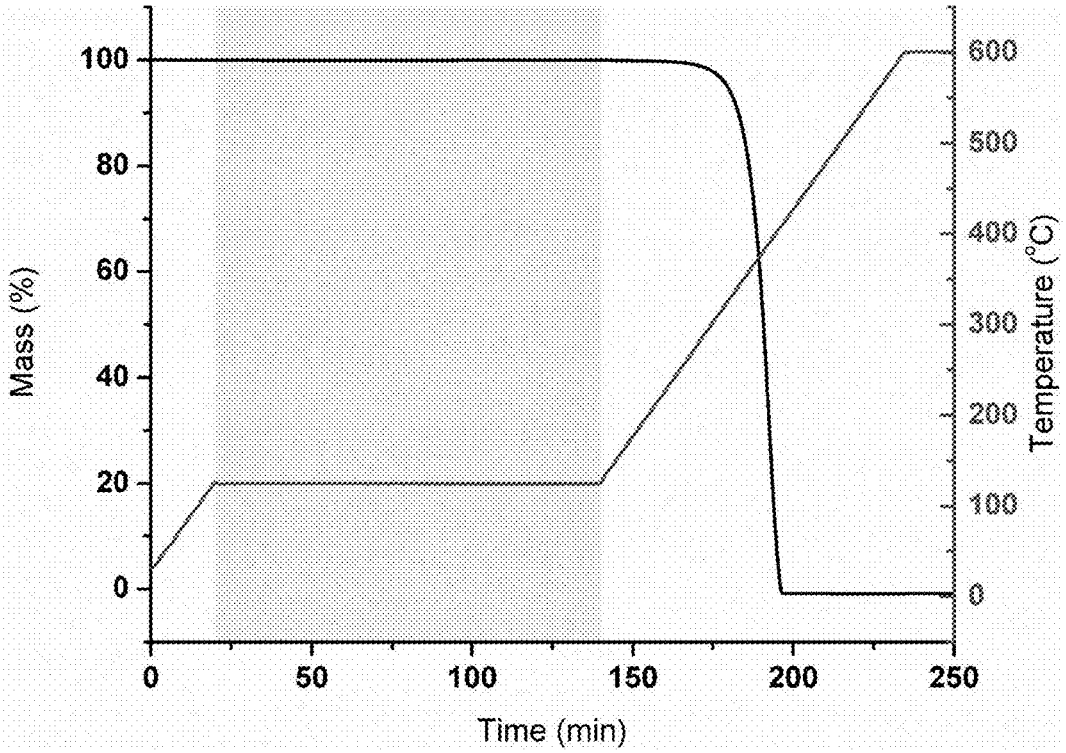

FIG. 1C. TG trace of C12Cyc. Temperature was increased from 30° C. to 125° C. at a rate of 5° C./min, held at 125° C. for 120 minutes and then increased from 125° C. to 600° C. at a rate of 5° C./min, and finally held at 600° C. for 30 minutes. The shaded area indicates period where temperature was held at 125° C.

FIGS. 2A-F. High temperature BL tests at 1.5 mm/s (A) and 15 mm/s (B). Corresponding percentage of friction reduction in Group III oil using different additives at 1.5 mm/s (C) and 15 mm/s (D). Wear coefficients of Group III oil with and without addition of C12Cyc and TC12T at 1.5 mm/s (E) and 15 mm/s (F).

Figures 3A, 3B, 3C:
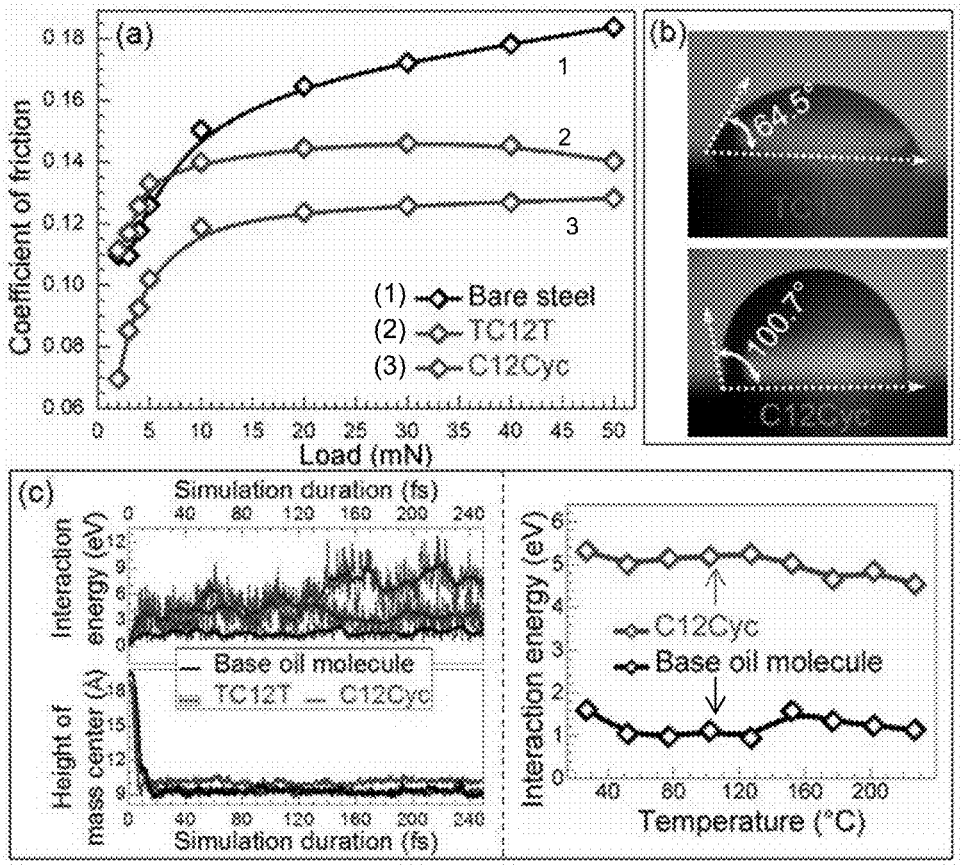

FIGS. 3A-C. (A) Comparison of nanoscratch friction for coatings of TC12T and C12Cyc on steel surface. (B) Measurements of water contact angle for coatings of TC12T and C12Cyc on steel surface. (C) MD modeling of the surface adsorption processes at room temperature (left) and at different temperatures (right).

Figure 4:
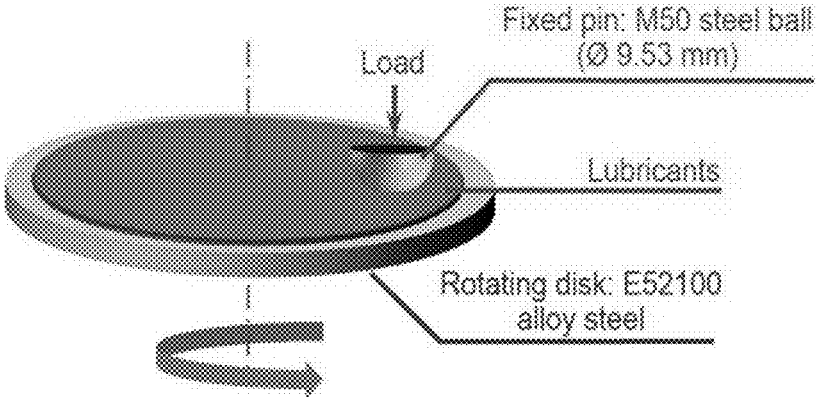

FIG. 4. Diagram of the pin-on-disk testing configuration.

FIGS. 5A-B. (A) Film thickness calculation for Group III oil. (B) Surface morphology and an example height profile of the polished E52100 steel.

Figure 6:
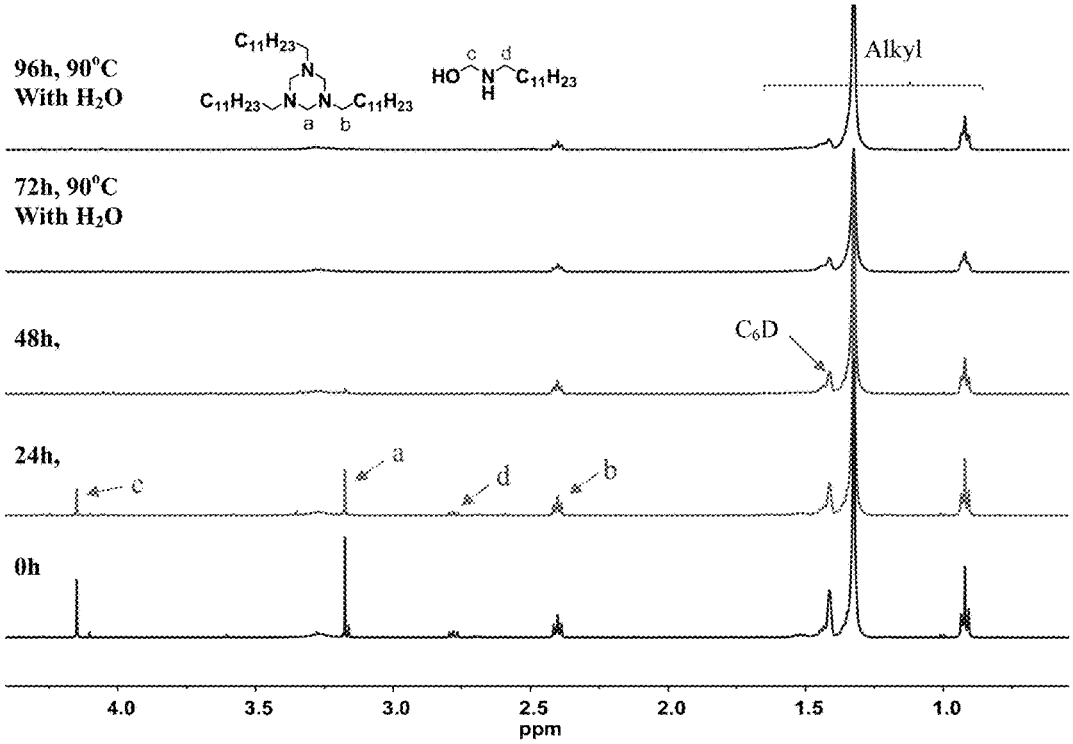

FIG. 6. Thermal stability 1H-NMR experiments in cyclohexane-$d_{12}$ for TC12T.

Figure 7:
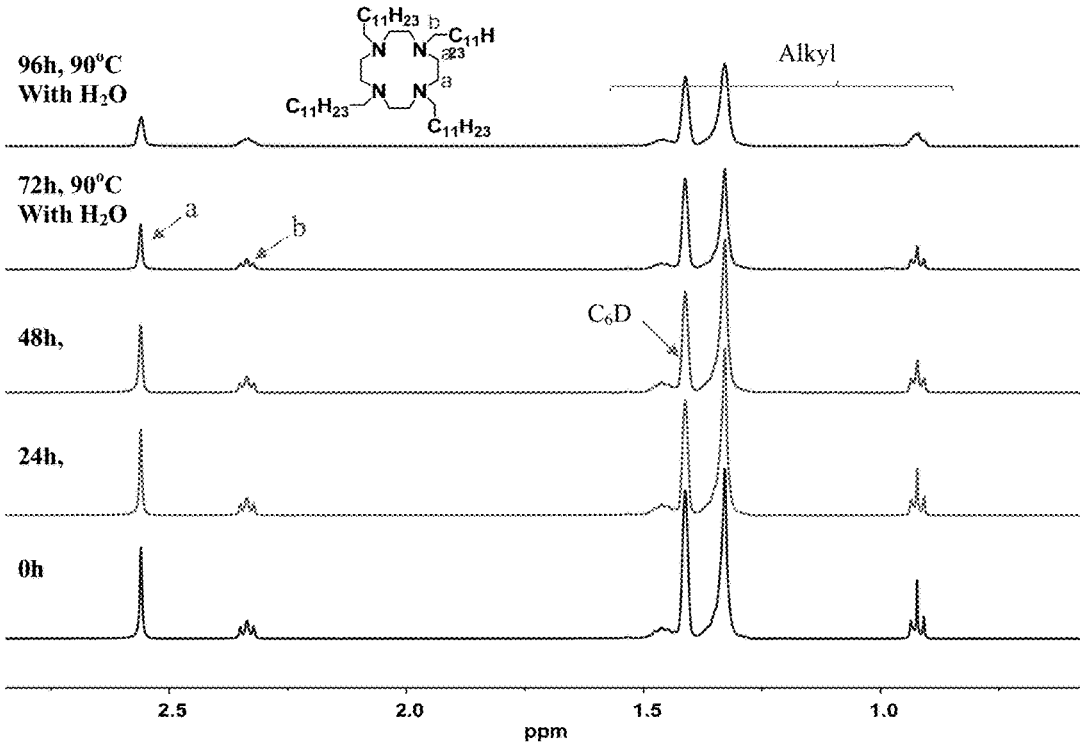

FIG. 7. Thermal stability 1H-NMR experiments in cyclohexane-$d_{12}$ for C12Cyc.

Figures 8A, 8B:
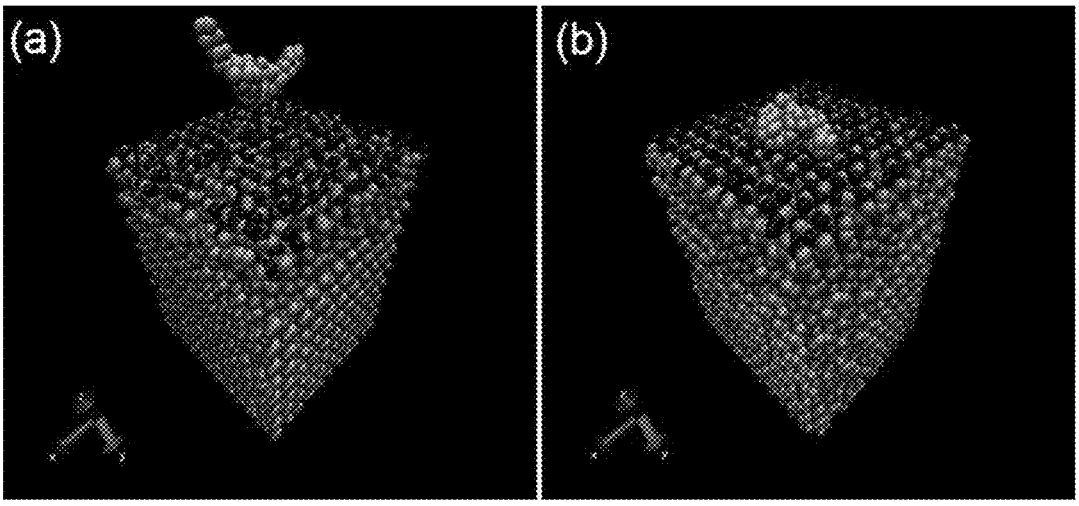

FIGS. 8A-B. MD simulation shows the approaching process before (A) and after adsorption (B). A TC12T molecule is used as example.

FIGS. 9A-B. (A) Example comparison of wear tracks after BL tests at 1.5 mm/s and under 100° C. (B) Example comparison of wear tracks after BL tests at 15 mm/s and under 200° C.

Figure 10:
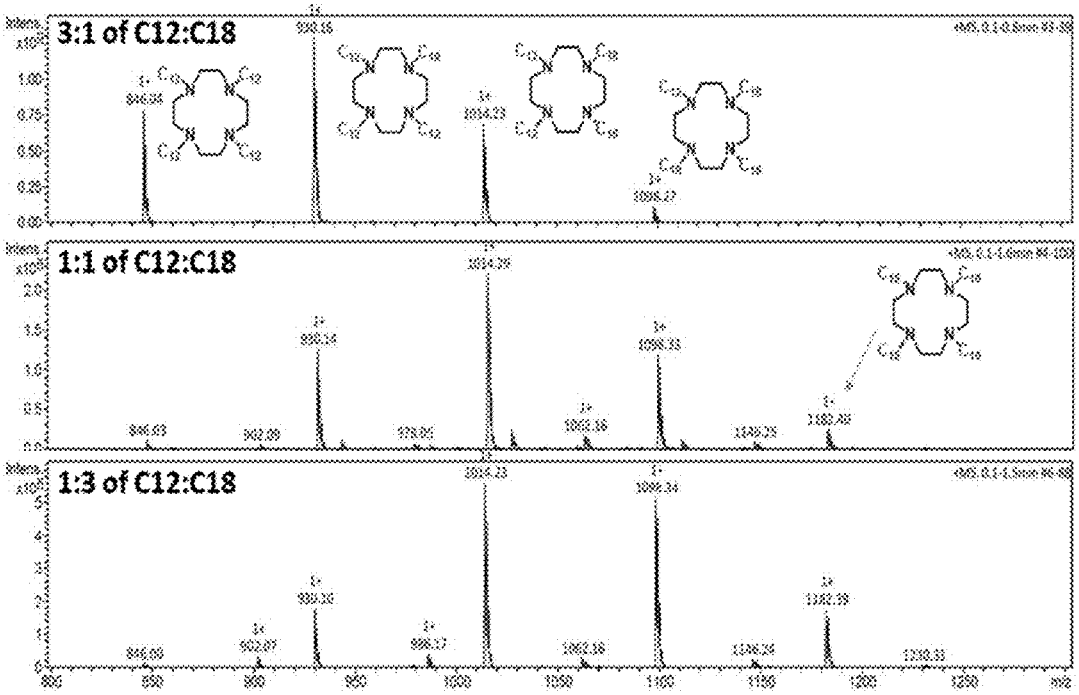

FIG. 10. ESI-MS of cyclen hybrids indicating how variation in the ratio of C12:C18 changes product mixture.

Figure 11A:
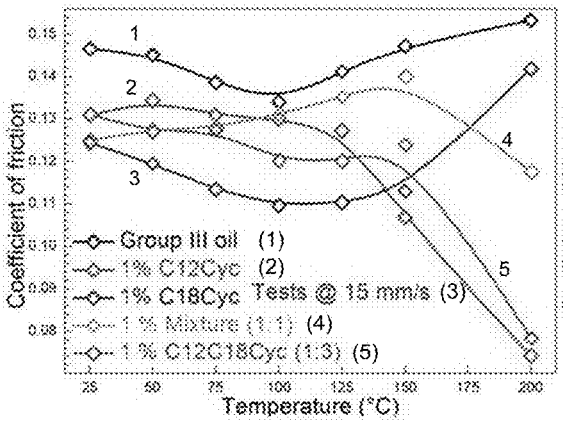
Figure 11B:
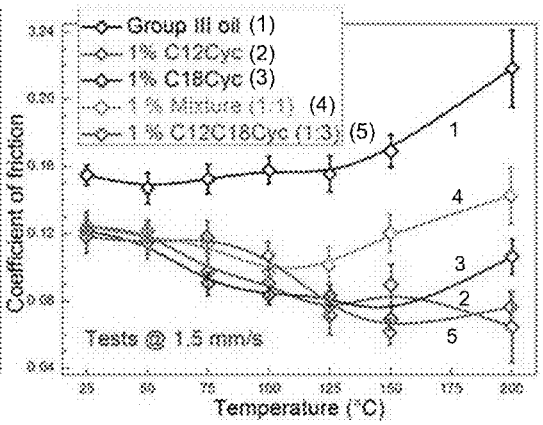

FIGS. 11A-B. Comparison of high temperature BL performances for cyclens and their hybrids at 15 mm/s (A) and 1.5 mm/s (B) in Group III oil.

Figure 12A:
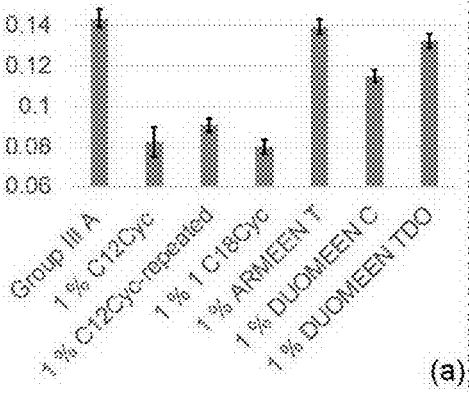
Figure 12B:
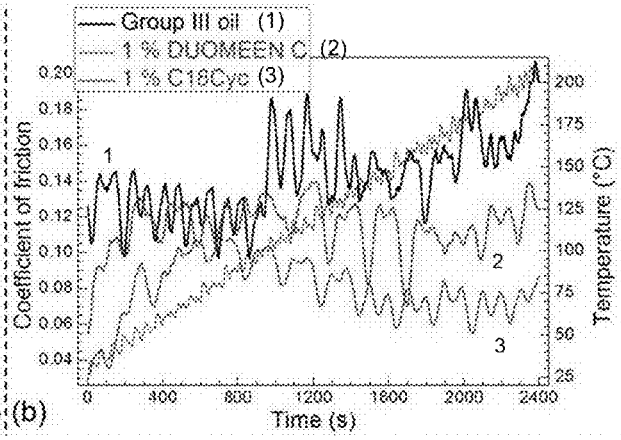

FIGS. 12A-B. (A) average friction coefficients for ramping tests at 1.5 mm/s; (B) variation of friction coefficients with time for temperature ramping studies at 1.5 mm/s.

DETAILED DESCRIPTION OF CERTAIN EMBODIMENTS

Illustrating various embodiments of this invention, stable nitrogen (N)-heterocycles can be used as organic BL additives. The nitrogen atoms employed, as discussed herein, have high Lewis basicity which promotes absorption to metal surfaces via hydrogen bonding or acid-base interactions. This invention teaches that the surface absorption of BL additives can be increased by increasing the number of basic nitrogen atoms in the polar head group. Incorporation of a nitrogen-containing heterocyclic molecular structure is a way to achieve this in a single molecule. The American Society for Testing and Materials (ASTM) sequence IIIG specifies a "moderately high" temperature for automotive engine oil as 150° C., which is equivalent to a truck operating under heavy loads on a hot summer day. (International, A. West Conshohocken, Pa., 2012; Vol. ASTM D7320-14.) N-heterocycles can be synthesized with high thermal stability and good oxidation-resistance.

Two nitrogen heterocycles, a tri-dodecyl hexahydro-1,3,5-triazine (TC12T) and a tetradodecyl-1,4,7,10-cyclen (C12Cyc) were synthesized and evaluated as heterocyclic BL additives (inset of FIG. 1A). (See examples, below.) Thermal stability analyses of synthesized additives were carried out by thermo-gravimetric analysis (TGA) and by monitoring structural changes during extended heating by proton nuclear magnetic resonance (1H-NMR) spectroscopy. TGA curves show that C12Cyc does not lose mass until ~300° C., while TC12T starts to lose mass at ~100° C. (FIG. 1A). The continuity of the C12Cyc curve also indicates that the molecule does not decompose and there is only a single compound present. By contrast, the TC12T curve shows shoulders at 20 and 10 mass %, corresponding to an acyclic hemiaminal side product, indicating likely decomposition at elevated temperature. (Jones, G. O.; García, J. M.; Horn, H. W.; Hedrick, J. L. Org. Lett. 2014, 16, 5502; Graymore, J. J. Chem. Soc. 1932, 1353.) In FIG. 1B, heating tests at 90° C., the average operating temperature of a passenger vehicle engine, with periodic NMR analysis showed that the central heterocyclic structure in TC12T is destroyed after only 48 hours of heating. C12Cyc shows no structural changes throughout, even after the addition of 0.1 mL of water to simulate atmospheric moisture. (The full NMR spectra for the extended heating experiments can be found in FIGS. 6-7.) Without limitation to any one theory or mode of operation, the stability of cyclen over hexahydrotriazines can be attributed to the ethylene spacer between N atoms which increases the energetic barrier to ring-opening reactions. Thermo-stability is a necessary feature for BL additives if efficient and persistent friction reduction at high temperatures is desired.

The effectiveness of TC12T and C12Cyclen at reducing BL friction was analyzed by a pin-on-disk tribometry. Film thickness calculation shows that pin-on-disk tests at 1.5 and 15 mm/s are within the BL regime (FIG. 5). In a gasoline engine, the crank train, the valve train, and the piston-liner contact are the three primary sources of energy losses to friction and can reach temperatures up to 200° C., and useful BL additives are able to function in this temperature range. FIG. 2 shows the temperature influence on BL performances of Group III oil with and without the heterocyclic additives at 1 wt. % concentration. The Coefficient of friction (CoF) of Group III base oil increases with temperature (plots 1, in FIGS. 2A and 2B) due to asperity contact severity, tribothermal oxidation, and tribochemical reactions. TC12T reduces friction at room temperature only (plots 2, in FIGS. 2A and 2B). The TGA and NMR experiments reveals that TC12T starts to decompose up on heating, corresponding to the decrease in its performance, corresponding to the decrease in its performance at high temperatures in the pin-on-disk test. C12Cyc has an exceptional thermally stability, and as a result, a continuous friction reduction throughout the temperature range tested is obtained (FIGS. 2A and 2B). Because the ring structure is not fragmented, the ability to adsorb to the steel surface is not affected. FIGS. 2C and 2D show percentage friction reduction as a function of temperature relative to neat Group III oil. At 1.5 mm/s, percentage friction reduction is more than 50% at 90° C., the average operating temperature of a motor vehicle engine, but reaches 75% at 200° C. (FIG. 2C). C12Cyc maintains its efficient functionality as a BL additive at 15 mm/s, with percentage friction reduction ranging from 15 to 50% as temperature increases (FIG. 2D).

BL friction reduction of C12Cyc is also compared to Pennzoil®, a commercial fully-formulated motor oil. Pennzoil® has a lower CoF than the neat Group III oil over the tested temperature range. However, Pennzoil® is outperformed by inclusion of 1 wt % C12Cyc in Group III at every temperature point at 1.5 mm/s, and most at 15 mm/s. At high temperatures, the CoFs for C12Cyc are more than 40% lower than those for Pennzoil®. Employing C12Cyc in commercial motor oils could yield beneficial BL regime friction reduction.

A thermostable heterocyclic molecule with multiple polar centers reinforces the adsorbed lubricant film and promote an effective asperity separation. Nanoscratch tests on steel substrates dip-coated in additive solutions demonstrate the enhanced surface adsorption for C12Cyc (FIG. 3A). When the applied load is small (≤5 mN), adhesion friction dominates the small-load nanoscratch process. TC12T coating performs similarly to bare steel while C12Cyc coating generates lower CoFs in this region—indicating that C12Cyc has better surface adsorption and lower intermolecular cohesion allowing it to form a lubricious layer on the surface. As the applied load increases (>5 mN), the high-load nanoscratch process is dependent on ploughing friction. TC12T coating has lower CoFs than bare steel, but C12Cyc coating is still the best performer. The C12Cyc has a greater concentration of hydrocarbon chains adsorbed on the steel surface which better counteract ploughing processes by forming a protective barrier.

Contact angle goniometry with water is used to determine the hydrophobicity of the dip-coated surface. The non-polar hydrocarbon chains on the additive will repel polar water molecules and allow a relative comparison of their concentration. In FIG. 3B, C12Cyc has a greater contact angle—indicating a higher concentration of hydrocarbon chains adsorbed on the surface than TC12T and reduction of BL regime friction. In addition, C12Cyc will more effectively entrain base oil molecules through favorable intermolecular interactions and thus leads to an extra BL friction reduction.

Molecular dynamics (MD) simulations are used to complement the experimental results and confirm that increasing the number of hydrogen bond acceptors, nitrogen atoms, in the central ring will increase the ability of the additive to form an adsorbed layer on the metal surface. As the center of mass of additives approaches the substrate, the energy of interaction increases (FIG. 3C, left). C12Cyc has a higher surface interaction energy than TC12T and base oil molecules, indicating that it absorbs more strongly to the surface. The ability of C12Cyc to substantially reduce friction at 200° C. in the pin-on-disk tests can be explained by how it maintains a high energy of interaction with the surface even at this temperature (FIG. 3C, right).

Analyses of the wear scars from the pin-on-disk tests were carried out by white light interferometry. TC12T, which has much poorer thermal stability, also has much poorer anti-wear functionality. C12Cyc is able to substantially reduce the wear coefficient at 1.5 mm/s on the steel substrate (FIG. 2E) by an order of magnitude. (Specific wear scar examples are given in FIG. 9.) Void volumes are reduced, indicating less abrasive wear, and deformed materials built up by the wear track decreases, implying less adhesive wear. It is also noted that tribochemical reactions usually occur via generation of reactive intermediates or unstable free radicals. The adsorbed C12Cyc molecular layer may be suppressing tribochemical processes and protecting the steel surface from wear by stabilizing these reactive species and intermediate radicals. At 15 mm/s, C12Cyc does not decrease wear consistently, only appreciably decreasing wear below 75° C. and above 125° C. (FIG. 2F).

As discussed above, among the heterocyclic additives studied, cyclen derivatives demonstrate great potential for motor oil applications. Development continues to address two on-going concerns: Instable friction process at relatively high speeds and oil solubility of cyclens with long side chains (e.g., C18Cyc). Initial BL tests at 15 mm/s showed that C12Cyc did not perform as well as C18Cyc at temperatures below 125° C., but the former outperformed the latter at temperatures above 125° C. Moreover, at the relatively low speed (i.e. 1.5 mm/s), both cyclens demonstrated similar performance. However, C18Cyc exhibited a long-term solubility issue, particularly at low temperatures. In particular, C18Cyc fell out of solution below 50° C., creating a waxy coating on the mechanical surface.

To improve the lubrication stability and solubility of cyclens, hybrid cyclen derivatives with a mixture of side chains were designed and synthesized. It was thought that breaking the symmetry of the molecule would help reduce the likelihood of molecules crystalizing and falling out of solution. This objective was achieved by introduction of a mixture of alkyl side chains during synthesis. For instance, this approach affords 4-5 types of cyclen molecules in the product mixture, ranging from no C18 chains with only C12 chains to only C18 chains with no C12 chains. By varying the ratio of C12:C18, the hybrid products can be varied to an extent, as shown by Electron Spray Ionization-Mass Spectrometry (ESI-MS) in FIG. 10.

During the high temperature experiments, simple mixtures with the same side chain ratios were also studied as references. Three C12:C18 ratios were tested for the simple mixtures and hybrids of cyclens: 1:3, 1:1, and 3:1. Both mixtures and hybrids can improve oil solubility of long-chain cyclens. For the high temperature BL tests carried out, the C12:C18 ratios of 1:1 and 1:3 were found to be the best combinations for simple mixtures and hybrids, respectively. The results are shown in FIGS. 11A-B with the corresponding pure cyclen derivatives. At both speeds in the BL experiments, the simple mixtures tested do not reduce friction as effectively as pure cyclens. Hybrids tested did optimize the BL performances at 15 mm/s. As shown in FIG. 11A, the selected cyclen hybrid shows the desirable friction reduction at temperatures below 125° C. for C12Cyc. Meanwhile in the same figure, it is observed that the significantly low friction coefficient of C12Cyc at temperatures above 125° C. is well maintained after hybridizing the shorter side chains with longer ones. Such hybridization of side chains does not sacrifice the excellent low-speed performance for the optimization at the relatively high speed (FIG. 11B). The hybrids thereby render a facile approach toward optimization of high temperature BL performance for cyclen derivatives.

Lubrication breakdown and oil aeration normally occur during start/stop operations for engines and transmissions. Asperity friction is especially severe at cold starts. To assess such issues, a temperature ramping study was adopted in the pin-on-disk tests. During the tests, temperature increased from 25° C. to 210° C. in 40 minutes. All tests results are compared with the commercial FMs, and representative results are shown FIG. 12. When the testing speed is low, i.e. 1.5 mm/s, cyclen derivatives are found to have the smallest average friction coefficient (FIG. 12A). After the first ramping test, the lubricants were cooled down and the tests were repeated. The new additives maintained excellent BL performance while temperature was ramped again, and results are shown for C12cyc in FIG. 12A. FIG. 12B shows corresponding variation of friction with ramping duration at 1.5 mm/s, in which the best heterocyclic additives are compared with the base oil and a leading, commercial FM (i.e. Duomeen C™, available from AkzoNobel). Throughout the temperature ramping process, both the present cyclen compounds and commercial additives have lower coefficients of friction than does the base oil, but the cyclens have the lowest friction coefficients. It is also noted from FIG. 12B that C18Cyc reduces friction continuously during the later ramping stage (when temperature was increased to ~75° C. or above), while the other lubricants do not display similar trends. As distinguished from prior high temperature tribo-tests, these temperature ramping experiments mimic engine starts with cool motor oil inside. The results shown here demonstrate the effectiveness of the present heterocyclic additives in mitigating excess friction during cold starts.

EXAMPLES OF THE INVENTION

The following non-limiting examples and data illustrate various aspects and features relating to the compositions, composites and/or methods of the present invention, including cyclen compounds comprising a variety of pendent alkyl moieties, as are available through the synthetic methods described herein. In comparison with the prior art, the present compositions, composites and methods provide results and data which are surprising, unexpected and contrary thereto. While the utility of this invention is illustrated through the use of several compositions, cyclen components and moieties and/or substituents which can be incorporated therein, it will be understood by those skilled in the art that comparable results are obtainable with various other compositions and cyclen components/moieties/substituents, as are commensurate with the scope of this invention.

Materials.

1-Dodecylamine, 37% formaldehyde solution in methanol, 1-bromododecane and 2.5M n-butyllithium in hexanes were commercially obtained from Sigma Aldrich and used as received. 1,4,7,10-Tetraazacyclododecane (cyclen) was commercially obtained from Matrix Scientific and used as received. All manipulations of air-sensitive materials were carried out with rigorous exclusion of oxygen and moisture in flame- or oven-dried Schlenk-type glassware on a dual-manifold Schlenk line. Tetrahydrofuran (THF) was purified by distillation from Na/benzophenone ketyl. The deuterated solvents chloroform-d ($CDCl_3$) and cyclohexane-$d_{12}$ ($C_6D_{12}$) were obtained from Cambridge Isotope Laboratories (>99 atom % D) and dried over 3 Å molecular sieves. A commercial Group III oil from Ashland Inc. was used as the base oil without further treatment, which is a typical base oil for automotive applications. A commercial fully formulated oil (Pennzoil® motor oil) was used as a reference in tribo-tests. E52100 steel disks from McMaster-Carr were used in tribo-tests, and their hardness was measured to be ~545.19 HV (5.347 GPa). Its typical chemical composition is as the following: sulfur, ~0.025 wt. %; silicon, ~0.15-0.35 wt. %; phosphorus, ~0.025 wt. %; manganese, ~0.25-0.45 wt. %; chromium, ~1.30-1.60 wt. %; carbon, ~0.95-1.1 wt. %; and balance iron.

Characterizations and Tribological Investigations.

Nuclear magnetic resonance (NMR) spectra were recorded on Varian UNITY Inova™ 500 (FT, 500 MHz, 1H; 125 MHz, 13C) or Agilent F500 (DDR2, FT, 500 MHz, 1H; 125 MHz, 13C) instruments. Chemical shifts for 1H and 13C spectra were referenced using internal solvent resonances. Elemental analyses were performed by Galbraith Laboratories, Inc. (Knoxville, Tenn.).

Example 1

In order to investigate stability while in a solvated state, NMR samples of the additives were heated at 90° C. for two days in cyclohexane-$d_{12}$. Chloroform-$d_1$ was used for $^1$H- and $^{13}$C-NMR to verify structure and purity because peaks were better resolved and the chloroform solvent peak (δ 7.26 ppm) did not overlap with compound peaks; however, cyclohexane-$d_{12}$ was chosen for thermal stability $^1$H-NMR tests because it would better mimic the nonpolar aprotic environment of base oil, even though the cyclohexane solvent peak (δ 1.41 ppm) overlaps with some of the alkyl proton peaks. After these two days, 0.1 mL of deionized $H_2O$ was added to the NMR samples, mixed and heated for two more days to mimic atmospheric moisture dissolved in the base oil. NMR spectra were taken once each day during the test.

Example 2a

With reference to FIG. 1A, Thermo-gravimetric analysis (TGA) to evaluate the thermal stability of additives was performed on a TA Instruments TGA/Q50 instrument at a ramp rate of 5° C./min from 25° C. to 800° C. under a $N_2$ flow rate of 90 mL/min at atmospheric pressure.

Example 2b

With reference to FIG. 1C, thermogravimetric analysis was performed on C12Cyc at a constant, elevated temperature. The sample was heated to 600° C. at a rate of 5° C./min and then held at 125° C. for 2 hours. No mass loss was detected during the 2 hour hold at 125° C., demonstrating that C12Cyc is stable at most temperatures it is likely to be exposed to in an automotive engine.

Example 3

Water contact angles were measured using an AmScope MU300 Microscope Digital Camera. Nanoscratch tests were carried out in a nanoindentation-tribotesting system (NanoTest 600, Micro Materials Ltd, UK) by varying the loads from 2 mN to 50 mN. BL additives were coated on 52100 steel substrates before the nanoscratch experiments. Samples for water contact angle goniometry and for nanoscratch tests were prepared by dip-coating a 52100 polished steel substrate (1 cm×1 cm) in a 5 wt. % solution of the additive in PAO4 oil at 120° C. for 12 hours, and then washing with toluene until there was no streaking on the surface.

Example 4a

Pin-on-disk tests were carried out using a CETR UMT-2 tribometer. As shown in FIG. 4, the pin-on-disk configuration consisted of a rotating disk (E52100 steel) and a fixed pin (M50 bearing steel ball, Ø 9.53 mm). 1 ml lubricants (Group III oil with and without 1 wt % TC12T or C12cyc) were added on the disk. Both BL additives were simply dispersed in the base oil via ultrasonication for 20 minutes. During the measurements, linear speeds changed from 1.5 mm/s to 15 mm/s at various temperatures (from 25° C. to 200° C.) under 3N (~700 MPa of max Hertzian contact pressure). The duration of each test was 30 minutes. Averaged friction coefficients were obtained from original data and the standard deviation was used to calculate corresponding error.

Example 4b

In order to confirm that pin-on-disk tests are carried out in the BL regime, film thicknesses are calculated first for the Group III oil by numerically solving the following Reynolds equation:

$$\frac{\partial}{\partial x}\left(\frac{\rho h^3}{12\eta}\frac{\partial P}{\partial x}\right)+\frac{\partial}{\partial y}\left(\frac{\rho h^3}{12\eta}\frac{\partial P}{\partial y}\right)=u\frac{\partial}{\partial x}(\rho h)$$

where, x and y are the bearing width and length coordinates; P is fluid film pressure; u is the relative rolling speed; h is fluid film thickness; ρ is fluid density; and η is treated as the averaged viscosity across the film. Kinematic viscosity used for the calculations were measured using a capillary viscometer (CANNON® Instrument Company) in a constant-temperature bath. The kinematic viscosity of Group III oil are 33.7 cst and 4.23 cst at 25° C. and 100° C., respectively. An exponential viscosity-pressure model and Dowson-Higginson density-pressure relationship were used. A discrete convolution-fast Fourier transform (DC-FFT) method was utilized to calculate elastic deformation.

Example 4c

In the base oil, lubricating film thickness is calculated to range from several nanometers to about one micrometer (FIG. 5A). This film thickness decreases with temperature. Polished E52100 steel was used in our tribological tests, and its surface morphology was imaged using a white light interferometer (FIG. 5B). Its surface roughness was measured to be ~6 nm. Under 1.5 mm/s and 15 mm/s of operations, the oil film thickness is calculated to be smaller than the surface roughness. These low speed pin-on-disk tests should have enabled the lubrication process to be well in the desired BL regime.

Example 4d

Wear tracks were examined using a 3D Optical Surface Profiler (Zygo® NewView™ 7300). Wear coefficient is calculated using the below Archard equation:

$$\text{Wear coefficient (K)} = \frac{\text{Wear volume (m}^3\text{)} \times \text{Surface hardness (Pa)}}{\text{Normal load (N)} \times \text{Sliding distance (m)}}$$

Example 5

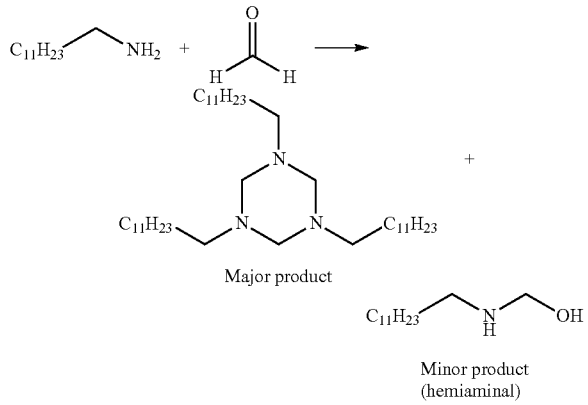

Synthesis of 1,3,5-Tri(dodecyl) hexahydro-1,3,5-triazine (TC12T)

A single-neck 250 mL round bottom flask with a stir bar, was charged with 1-dodecylamine (12 mL, 54 mmol) and 50 mL of MeOH. Formaldehyde (37 wt. % in $H_2O$, 6.2 mL, 75 mmol) was added gradually with magnetic stirring. The reaction was allowed to mix for 5 hours, then the product was extracted with hexanes, washed three times with deionized (DI) water, dried with $MgSO_4$ for 5 hours, filtered to remove particulate and concentrated to dryness with rotary evaporation to yield a clear, viscous liquid (60.9% yield of major product). $^1$H NMR of major product ($CDCl_3$): δ 3.25 (s, 6H, —$NCH_2N$—), 2.39 (t, 6H, —$NCH_2CH_2$—), 1.44 (qu, 6H, —$NCH_2CH_2CH_2$—), 1.25 (m, 54H, hydrocarbon chain), 0.88 (t, 9H, —$CH_2CH_3$). $^{13}$C NMR ($CDCl_3$): 86.83, 74.88, 55.07, 53.04, 49.88, 31.74, 29.84, 29.80, 29.73, 29.67, 29.52, 28.91, 27.81, 27.70, 27.37, 22.85, 14.27. Elemen. Anal. Calc'd for $C_{56}H_{116}N_4$: C, 79.11; H, 13.79; N, 7.10. Found: C, 75.05; H, 18.79; N, 6.16.

Example 6

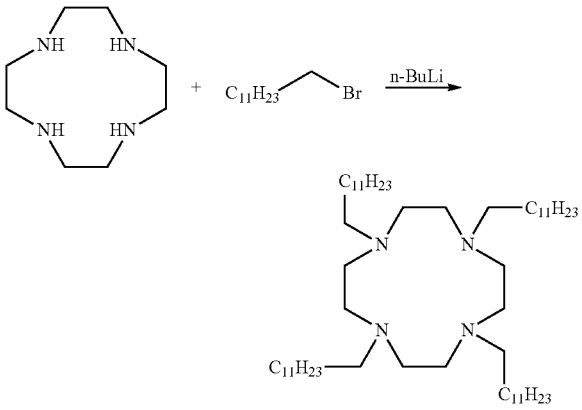

Synthesis of 1,4,7,10-Tetra(dodecyl)-1,4,7,10-tetraazacyclododecane (C12Cyc)

Synthesis adapted from Xiong, X.-Q. et al. (Xiong, X.-Q.; Liang, F.; Yang, L.; Wang, X.-L.; Zhou, X.; Zheng, C.-Y.; Cao, X.-P. *Chem. Biodivers.* 2007, 4, 2791.) Charged a 250 mL oven-dried Schlenk flask and stir bar with 1,4,7,10-tetraazacyclododecane (1 g, 5.8 mmol), cap with a rubber septum and evacuated on Schlenk line for 15 minutes. Placed Schlenk flask under positive nitrogen pressure and added 75 mL of THF by syringe. Cooled reaction flask to −78° C. in a dry ice-acetone bath with magnetic stirring. Added n-BuLi solution (2.5 M in hexanes, 10.2 mL, 25.5 mmol) gradually by syringe and let mix for 1 hour at −78° C., then transferred to an ice-water bath and let stir for 1 hour at 0° C. Added 1-bromododecane (5.6 mL, 23.2 mmol) by syringe and let stir for 2 hours at 0° C. Quenched reaction with 5 mL of ethanol. Removed solvent with rotary evaporation, dissolved remaining residue in dichloromethane, filtered out insoluble particles and concentrated to dryness. Purified by recrystallization from methanol and then recrystallization from hexanes to yield a fluffy, white solid (31% yield). $^1$H NMR ($CDCl_3$): δ 2.61 (s, 16H, —$NCH_2CH_2N$—), 2.36 (t, 8H, —$NCH_2CH_2$—), 1.43 (qu, 8H, —$NCH_2CH_2CH_2$—), 1.26 (m, 72H, hydrocarbon chain), 0.88 (t, 12H, —$CH_2CH_3$). $^{13}$C NMR ($CDCl_3$): 56.23, 52.19, 31.95, 29.74, 29.71, 29.70, 29.68, 29.39, 27.75, 27.35, 22.71, 14.14. Exact Mass (ESI-MS) 845.13 m/z. Elem. Anal. Calc'd for $C_{56}H_{116}N_4$: C, 79.55; H, 13.83; N, 6.63. Found: C, 79.59; H, 14.37; N, 6.64.

Example 7

While the synthesis of C12Cyc (n=1) is described in the preceding example, it will be understood by those skilled in the art and made aware of this invention that various other such N-heterocyclic compounds can be prepared and utilized as described herein, in accordance with other embodiments of this invention—such preparation using synthetic techniques of the sort described above or straight-forward variations thereof, as would also be understood by those skilled in the art and made aware of this invention, such N-heterocyclic compounds limited only by the commercial or synthetic availability of corresponding azacycloalkane, bromoalkane and substituted (i.e., alkyl substituents including but not limited to those discussed above) bromoalkane starting materials.

Example 8

Molecular Dynamic (MD) Simulation of the Surface Adsorption.

An all atom MD simulation was used to explain the adsorption process of the additive molecules on a hydrated silica surface. Base oil [polyalphaolefin (PAO)] molecules, TC12T molecules, and C12Cyc molecules were simulated in LAMMPS. For the silica substrate, two hydroxyl was artificially grafted on each silicon atom on its (100) surface. (Lopes, P. E. M.; Murashov, V.; Tazi, M.; Demchuk, E.; MacKerell, A. D. J. *Phys. Chem. B* 2006, 110, 2782.) By doing so a hydroxyl coverage was about 8 molecules/nm$^2$. This coverage was the partial charge of all the atoms in the simulation cell were calculated and assigned by the Charge Equilibration (QEq) method in the Material studio. (Rappe, A. K.; Goddard, W. A. *J. Phys. Chem.* 1991, 95, 3358.) The forcefield used for the silicon substrate was a widely used Tersoff forcefield. (Tersoff, J. *phys. Rev. B* 1988, 37, 6991.) The forcefield used for the BL additive molecules was Consistent Valence Forcefield (CVFF). (Dauber-Osguthorpe, P.; Roberts, V. A.; Osguthorpe, D. J.; Wolff, J.; Genest, M.; Hagler, A. T. *Proteins: Struct., Funct., Bioinf.* 2004, 4, 31; Maple, J. R.; Dinur, U.; Hagler, A. T. *Proc. Natl. Acad. Sci. U.S.A.* 1988, 85, 5350.)

$$E_{total} = \sum D_b[1 - e^{-\alpha(b-b_0)}] + \sum H_\theta(\theta - \theta_0)^2 + \sum H_\phi[1 + s\cos(n\phi)] + \sum H_\kappa \kappa^2 + \sum 4\varepsilon\left[\left(\frac{\sigma}{r_{ij}}\right)^{12} - \left(\frac{\sigma}{r_{ij}}\right)^6\right] + \sum \frac{q_i q_j}{r_{ij}}$$

The simulation configuration is shown in FIG. 8. The silica substrate dimension is 54 Å×54 Å×70 Å, and the [001] direction of the silica structure is set as the z axis. The periodic boundary condition is applied in x and y direction only. The dark purple and black balls on the surface are grafted hydroxyl groups. The green molecule above the substrate is the BL additive. Only a TC12T molecule is shown here as an example. At the beginning, the geometry of the molecules was optimized by the CASTEP module with a B3LYP ultra-fine level of accuracy in the Material Studio. The optimized organic molecules were then simulated in LAMMPS. An energy minimization process was used to fully relax the system first, following which a Canonical (NVT) ensemble was used to simulate the adsorption process. As shown in FIG. 9, the additive molecules were placed ~12 Å above the substrate initially, and all the molecules were adsorbed and attracted thereafter by the hydrated surface. The total simulation time lasted about 250 fs.

A variety of cyclen compounds, were synthesized, then structurally and tribologically characterized. As compared to the prior art, the cyclen compounds had much greater thermal stability, as evidenced by NMR studies and TGA, as well as greater surface adsorption and BL enhancement, shown experimentally by pin-on-disk tests, nanoscratch measurements, and contact angle goniometry. MD simulations support the experimental observations and conclusions about surface adsorption, showing that, for instance, the C12Cyc energy of interaction is preserved at elevated temperature (200° C.). Such performance can be attributed to having four or more hydrogen bond acceptors in a central ring, which improves surface adsorption, and multiple hydrocarbon chains in the same molecule, which improves interaction with base oil and asperity separation. Anti-wear functionality is a beneficial side effect of cyclen anti-friction capability.

We claim:

1. A composition comprising an oil component and a component comprising at least one cyclen compound of a formula

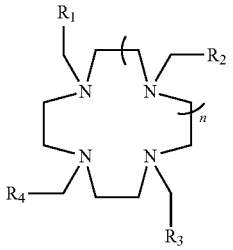

wherein each of $R_1$, $nR_2$, $R_3$ and $R_4$ ($R_1$-$R_4$) is a moiety independently selected from about $C_5$- about $C_{24}$ linear, substituted linear, branched and substituted branched alkyl moieties, where said substituents are selected from oxa (—O—), aza (—NH— or —N—), aryl, carbonyl, alkylcarbonyl, arylcarbonyl, oxycarbonyl (—OC(O)—), alkoxycarbonyl, amido (—NHC(O)—), alkylcarboxamido, arylcarboxamido, hydroxy, alkoxy, aryloxy, amino, alkylamino, arylamino, heteroaryl, heteroarylalkyl and heteroaryloxy substituents and combinations thereof; and n is an integer selected from 0- about 10.

2. The composition of claim 1 wherein each of $R_1$-$R_4$ is a $C_{10}$-$C_{20}$ alkyl moiety.

3. The composition of claim 2 wherein at least $R_1$ is a $C_{11}$ alkyl moiety.

4. The composition of claim 3 wherein each of $R_1$-$R_4$ is independently a linear $C_{11}$-$C_{18}$ alkyl moiety.

5. The composition of claim 4 wherein each of $R_1$-$R_4$ is a linear, unsubstituted $C_{11}$ alkyl moiety.

6. The composition of claim 5 wherein n is 1-3.

7. The composition of claim 1 wherein said oil component is selected from base oils and formulated commercially-available motor oils.

8. The composition of claim 7 wherein said cyclen component is about 0.1 wt. % to about 1.0 wt. % of said composition.

9. The composition of claim 1 wherein said cyclen component comprises a plurality of cyclen compounds.

10. A composition comprising an oil component and a component comprising at least one cyclen compound of a formula

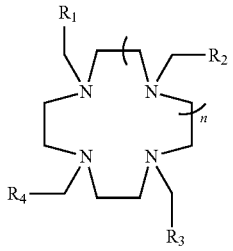

wherein each of $R_1$, $nR_2$, $R_3$ and $R_4$ ($R_1$-$R_4$) is a moiety independently selected from about $C_5$-about $C_{24}$ linear and branched alkyl moieties; and n is an integer selected from 0-about 10.

11. The composition of claim 10 wherein each of $R_1$-$R_4$ is a $C_{10}$-$C_{20}$ alkyl moiety.

12. The composition of claim 11 wherein at least $R_1$ is a $C_{11}$ alkyl moiety.

13. The composition of claim 12 wherein each of $R_1$-$R_4$ is independently a linear $C_{11}$-$C_{18}$ alkyl moiety.

14. The composition of claim 13 wherein each of $R_1$-$R_4$ is a linear, unsubstituted $C_{11}$ alkyl moiety.

15. The composition of claim 14 wherein n is 1-3.

16. The composition of claim 10 wherein said oil component is selected from base oils and formulated commercially-available motor oils.

17. The composition of claim 16 wherein said cyclen component is about 0.1 wt. % to about 1.0 wt. % of said composition.

18. The composition of claim 10 wherein said cyclen component comprises a plurality of cyclen compounds.

19. A composite comprising a metal substrate and an oil-cyclen composition of claim 1 coupled thereto.

20. The composite of claim 19 wherein said N-heteroatoms of said cyclen component of said composition are adsorbed to the surface of said substrate.

21. The composite of claim 20 wherein n is 1-3.

22. The composite of claim 21 wherein said adsorption is at temperatures up to and greater than about 200° C.

23. The composite of claim 19 wherein said oil component of said composition is a formulated commercially-available motor oil.

24. The composite of claim 19 wherein each of said cyclen $R_1$-$R_4$ is independently a linear $C_{11}$-$C_{18}$ alkyl moiety.

25. The composite of claim 24 wherein each of $R_1$-$R_4$ is a linear unsubstituted $C_{11}$ alkyl moiety.

26. The composite of claim 19 providing a water contact angle greater than about 90 degrees.

27. A method of using a cyclen compound to reduce boundary lubrication friction, said method comprising:

providing opposed, first and second metal substrates;

applying an oil-cyclen composition of claim 1 to at least one said metal substrate; and contacting said first and second metal substrates, said contact inducing boundary lubrication friction therebetween, said composition in an amount sufficient to reduce boundary lubrication friction between said substrates, said reduction compared to boundary lubrication friction induced by substrate contact with application of a composition absent a said cyclen compound.

28. The method of claim 27 wherein said oil component is selected from base oils and formulated commercially-available motor oils.

29. The method of claim 27 wherein said cyclen component is about 0.1 wt. % to about 1.0 wt. % of said composition.

30. The method of claim 27 wherein each of said cyclen $R_1$-$R_4$ is independently selected from linear $C_{11}$-$C_{18}$ alkyl moieties.

31. The method of claim 30 wherein each of $R_1$-$R_4$ is a linear unsubstituted $C_{11}$ alkyl moiety.

32. The method of claim 27 wherein said first and second metal substrates are selected from crank train, valve train and piston liner components of a gasoline engine.

33. The method of claim 29 wherein each of said cyclen $R_1$-$R_4$ is a linear unsubstituted $C_{11}$ alkyl moiety.

34. The method of claim 33 wherein said contact is over a temperature range of about 20° C. to about 260° C.

35. The method of claim 34 wherein said friction reduction is over said temperature range.

* * * * *